US011617394B2

(12) United States Patent
Wu et al.

(10) Patent No.: US 11,617,394 B2
(45) Date of Patent: Apr. 4, 2023

(54) LOW-TEMPERATURE BAKED VAPORIZER AND LOW-TEMPERATURE BAKED SMOKING SET

(71) Applicant: Shenzhen First Union Technology Co., Ltd., Shenzhen (CN)

(72) Inventors: Zexin Wu, Shenzhen (CN); Yonghai Li, Shenzhen (CN); Zhongli Xu, Shenzhen (CN)

(73) Assignee: Shenzhen First Union Technology Co., Ltd., Shenzhen (CN)

( * ) Notice: Subject to any disclaimer, the term of this patent is extended or adjusted under 35 U.S.C. 154(b) by 1196 days.

(21) Appl. No.: 16/171,968

(22) Filed: Oct. 26, 2018

(65) Prior Publication Data

US 2019/0124985 A1 May 2, 2019

(30) Foreign Application Priority Data

Oct. 27, 2017 (CN) ..... 201721416144.0
Oct. 12, 2018 (CN) ..... 201811193550.4

(51) Int. Cl.
*A24F 40/46* (2020.01)
*H05B 1/02* (2006.01)
(Continued)

(52) U.S. Cl.
CPC ..... *A24F 40/46* (2020.01); *H05B 1/0297* (2013.01); *H05B 3/46* (2013.01); *A24F 40/20* (2020.01); *A24F 40/50* (2020.01)

(58) Field of Classification Search
CPC ..... A24F 40/20; A24F 40/46; A24F 40/50
See application file for complete search history.

(56) References Cited

U.S. PATENT DOCUMENTS

2011/0155153 A1 6/2011 Thorens et al.
2011/0155718 A1* 6/2011 Greim ..... F24H 1/0018 219/507
2015/0007835 A1* 1/2015 Liu ..... A24F 40/46 131/329

FOREIGN PATENT DOCUMENTS

CN 203575658 * 5/2014 ..... A24F 47/00
CN 104 522 891 A 4/2015
(Continued)

OTHER PUBLICATIONS

CN203575658 (Machine Translation) [online], [retrieved on Jan. 14, 2022], retrieved from Google Patents (Year: 2014).*

*Primary Examiner* — Galen H Hauth
*Assistant Examiner* — Yana B Krinker
(74) *Attorney, Agent, or Firm* — PROI Intellectual Property US; Klaus Michael Schmid

(57) ABSTRACT

A low-temperature baked vaporizer and a low-temperature baked smoking set are disclosed, the vaporizer includes a sleeve, for receiving vaporizable materials; and a heating element, manufactured by metal materials and sleeved outside the sleeve, configured for heating the sleeve; the heating element includes a plurality of through holes, configured for adjusting resistance of the heating element such that the heating element generates heat evenly. By relying on all kinds of arrays of through holes, they make the whole resistance of the heating element even, with consequently making the current to be even during the vaporizer is working, therefore, the vaporizer generates heat evenly, ensures the tobacco cigarette to be heated evenly, to improve efficiency and stability of vaporizing smoking smog.

18 Claims, 13 Drawing Sheets

(51) Int. Cl.

| | |
|---|---|
| ***H05B 3/46*** | (2006.01) |
| *A24F 40/20* | (2020.01) |
| *A24F 40/50* | (2020.01) |

(56) References Cited

FOREIGN PATENT DOCUMENTS

| | | | | | |
|---|---|---|---|---|---|
| EP | 0822760 | A2 * | 2/1998 | ..... | A24C 5/01 |
| WO | 2011/109849 | A1 | 9/2011 | | |

* cited by examiner

LOW-TEMPERATURE BAKED VAPORIZER AND LOW-TEMPERATURE BAKED SMOKING SET

TECHNICAL FIELD

The present disclosure relates to the field of low-temperature baked smoking sets, and particularly, to a low-temperature baked vaporizer and a low-temperature baked smoking set having same.

BACKGROUND ART

The low-temperature baked smoking sets mainly use some solid vaporizable materials such as tobacco shreds or opium paste etc. to be baked at a low-temperature to generate smoking smog for inhaling. For this low-temperature baked smoking sets, their structure always has a hollow cylindrical vaporizer. In use, the solid vaporizable materials are disposed inside the cylindrical vaporizer, by the vaporizer, the solid vaporizable materials are heated to generate smoking smog.

In practice, to match up with the cylindrical shape of the solid vaporizable materials, the vaporizer is shaped like a cylinder. To let the vaporizer work well, normally electrode pins are welded on two ends of the vaporizer. In the process that the vaporizer is in use, the main shortage is uneven heating of the cylindrical vaporizer, which contributes to unevenly generated smoking smog. More specifically, the unfolded the cylindrical vaporizer shows the heating area and the heating element 1 in FIG. 1. Two longitudinal ends of the heating element 1 both have an electrode pin 2 for connecting the power supply. After giving the electricity, even though the heating element 1 as a whole is manufactured by the conductive materials, the current itself prefers the shortest itinerary with minimum resistance to form a current loop. For example, the two current loops A and B are shown in FIG. 1, the current loop A has a shorter itinerary than the current loop B between the two electrode pins 2, then most current prefers the current loop A to form the current loop, so most heat generated by the heating element 1 is centralized on the main heating area 3 in FIG. 1, whereas, the remaining area has less heat, so the heating element 1 as a whole generates heat unevenly.

SUMMARY

In view of the drawbacks in the prior art that vaporizable materials are heated unevenly by a heating element, the present disclosure relates to a low-temperature baked vaporizer.

In order to solve the above technical problem, the present disclosure provides a low-temperature baked vaporizer according to independent claim 1 whereas various embodiments of the vaporizer and improvements thereto are recited in the dependent claims. The vaporizer includes a sleeve, for receiving vaporizable materials; a heating element, manufactured by metal materials and sleeved outside the sleeve, configured for heating the sleeve, the heating element has a plurality of through holes that are configured for adjusting resistance of the heating element such that the heating element generates heat evenly.

Preferably, the plurality of through holes are divided to first through holes and second through holes; the first through holes and second through holes are configured to let the heating element heat evenly.

Preferably, the first through holes and second through holes are axially dispersed on the heating element; at least one first through hole is symmetrical with at least one second through hole.

Preferably, an insulating layer is disposed outside the sleeve and configured for avoiding the sleeve to be thermal conducted with the heating element.

Preferably, the vaporizer further includes a power supply module, electrically connected with the heating element, configured for supplying power to the heating element.

Preferably, the heating element has a cut, configured for the heating element to be easily sleeved on the sleeve; the cut is axially bored on the heating element, through a side wall of the heating element.

Preferably, the power supply module includes an USB interface, a battery, a control unit, a charge circuit, a discharge circuit, a voltage detecting circuit, two switches and a battery management circuit. The battery is respectively connected with the charge circuit and the discharge circuit. Two switches are respectively disposed between the battery and the charge circuit, and between the battery and discharge circuit. The charge circuit and the discharge circuit are both electrically connected with the USB interface, the discharge circuit is electrically connected with the battery management circuit; the battery management circuit is electrically connected with the heating element; the voltage detecting circuit is electrically connected with the USB interface; the control unit is connected with the two switches and the voltage detecting circuit respectively.

Preferably, the heating element includes at least one heating area extending along an axial direction thereof, and each heating area has electrode connecting parts.

The heating area has at least one set of through holes dispersed along a circumferential direction thereof; each set of through holes has at least one through holes.

Preferably, the heating area has a first side edge and a second side edge that are closing but contactless with each other; the electrode connecting parts, disposed between the first side edge and the second side edge, includes a first electrode connecting part and a second electrode connecting part disposed at two opposite axial ends of the heating area; between the first electrode connecting part and the second electrode connecting part defines multiple different current circuits along an circumferential direction of the heating area; each current circuit has same resistance.

Preferably, along the circumferential direction of the heating area, the through holes near to the first side edge or the second side edge have a smaller size than the through holes near to the electrode connecting parts.

Preferably, in the heating area, along the circumferential direction of the heating area, sizes of each set of through holes get smaller and smaller with deviating from the electrode connecting parts.

Preferably, in the heating area, along the circumferential direction of the heating area, distances between adjacent sets of through holes get larger and larger with deviating from the electrode connecting parts.

Preferably, in the heating area, along the circumferential direction of the heating area, adjacent sets of through holes are staggered with each other.

Preferably, in the heating area, along the axial direction of the heating element, the sizes of each set of through holes get smaller and smaller.

Preferably, in the heating area, along the axial direction of the heating element, distances between adjacent sets of through holes get larger and larger.

Preferably, the heating element includes a first heating area and a second heating area to be axially arrayed; the first heating area and the second heating area both have several sets of through holes to be circumferentially arrayed; the first heating area and the second heating area are in serial connection via a connector; the connector is a region with no holes.

Preferably, the first heating area has same sets of through holes with the second heating area in same size and same array, such that the first heating area has a same resistance with the second heating area.

Preferably, the first heating area has different sets of through holes with the second heating area in different size and different array, just to guarantee that the first heating area has a same resistance with the second heating area.

Preferably, the heating element has at least one temperature sensor thermally conducted with the heating areas, a number of the temperature sensors is the same with the number of the heating areas.

The present disclosure further provides a low-temperature baked smoking set having the aforementioned low-temperature baked vaporizer; the smoking set includes the aforementioned low-temperature baked vaporizer; and a power supply configured for supplying power to the vaporizer.

By relying on the through holes, they make the whole resistance of the heating element even, with consequently making the current to be even during the vaporizer is working, therefore, the vaporizer generates heat evenly, ensures the solid vaporizable materials to be heated evenly to improve efficiency and stability of vaporizing smoking smog.

Additional aspects and advantages of the present disclosure will be: the vaporizer and the electronic cigarette having the same bake the solid vaporizable materials to generate smoking smog, unlike traditional smoking sets which need to burn the vaporizable materials, so a variety of carcinogens are avoided when the vaporizable materials are burned, to decrease the damage to users. Moreover, compared with the traditional electronic cigarettes that the tobacco liquid is aerosolized, the smoking taste of the vaporizer and the electronic cigarette is more pure.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The structure and operating principle of the above low-temperature baked vaporizer and the low-temperature baked smoking set are illustrated below, mainly shown from FIG. 2 to FIG. 4 in further detail using exemplary embodiments.

Figure 1:
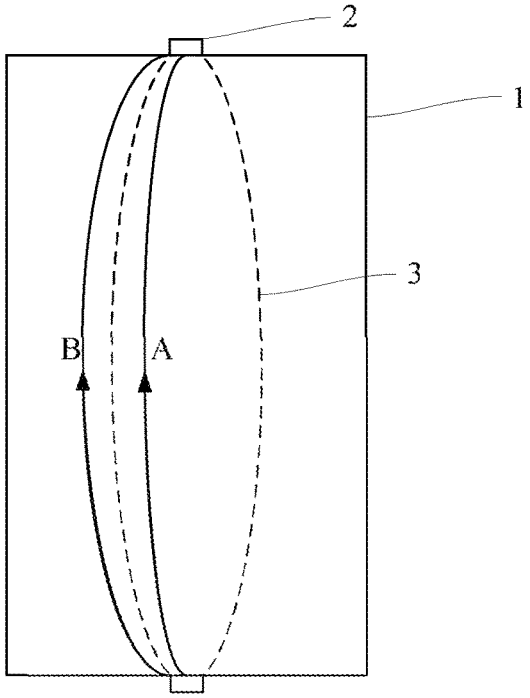
FIG. 1 illustrates an unfolded heating element of a low-temperature baked smoking set in the prior art.
Figure 2:
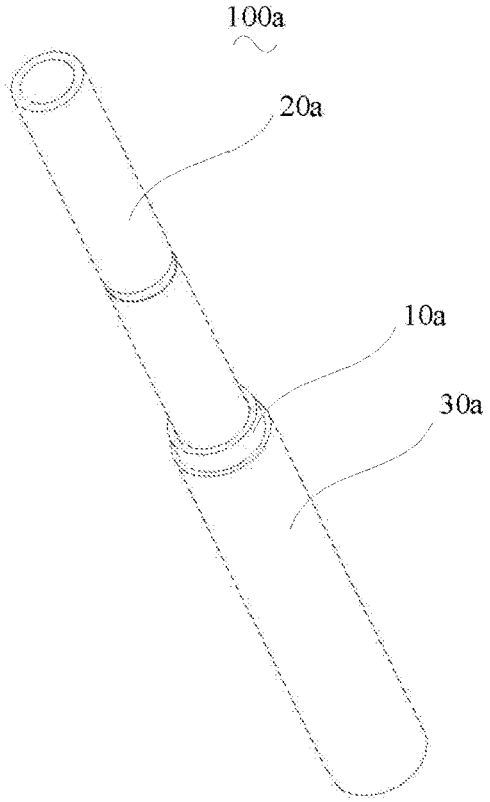
FIG. 2 is an isometric view of the low-temperature baked smoking set in accordance with an embodiment of the present disclosure.

Referring to FIG. 2, which is an isometric view of the low-temperature baked smoking set in accordance with an embodiment of the present disclosure. The low-temperature baked smoking set 100*a* includes a low-temperature baked vaporizer 10*a* and a housing 30*a*. The vaporizer 10*a* is accommodated inside the housing 30*a*. The vaporizer 10*a* is configured for receiving a cartridge 20*a* that is heated to generate smoking smog.

Figure 3:
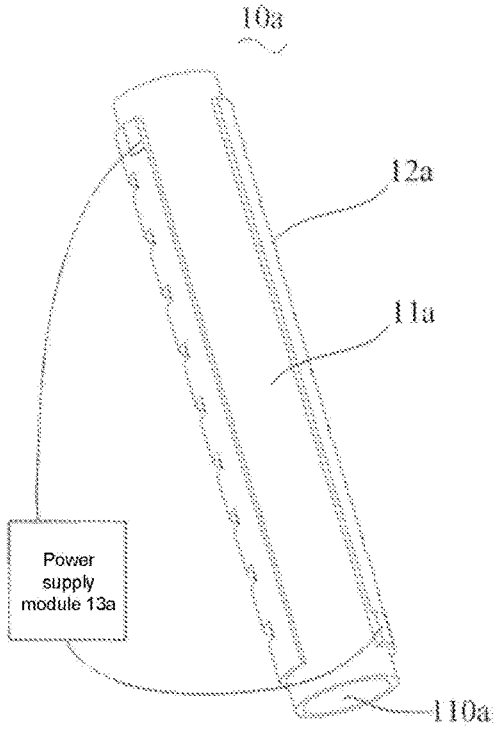
FIG. 3 is an isometric view of a vaporizer in the low-temperature baked vaporizer in accordance with an embodiment of the present disclosure.

Referring to FIG. 3, in this embodiment, the vaporizer 10*a* includes a sleeve 11*a*, a heating element 12*a* and a power supply module 13*a*. The sleeve 11*a* is configured for receiving vaporizable materials, that is tobacco cigarette; a heating element 12*a*, sleeved outside the sleeve 11*a*, and configured for heating the sleeve 11*a*; the power supply module 13*a* is electrically connected with the heating element 12*a* to heat the heating element 12*a*.

The sleeve 11*a* is roughly round, made by metal materials, at least any one selected from a group of pure metals, alloys, metallic compounds or special metals etc. such as iron, copper, aluminum, tin, nickel, gold, silver, lead, zinc or other alloys. An insulating layer (not shown) is disposed outside the sleeve 11*a* and configured for avoiding the sleeve 11*a* to be thermal conducted with the heating element 12*a*. The insulating layer is made up with insulating materials, at least any one selected from a group of synthetic resin, epoxy resin, phenolic resin, 4250 silicone plastic asbestos and polyimide plastic etc. The sleeve 11*a* has a receiving chamber 110*a* configured for receiving the solid vaporizable materials. An inner diameter of the receiving chamber 110 is defined as 5~8 mm, to ensure the solid vaporizable material to be easily inserted into and let the solid vaporizable material tightly abut against the receiving chamber, therefore, improving efficiency of heating the solid vaporizable material.

In some embodiments, the insulating layer sleeved outside the sleeve 11*a* is an oxide layer, for example, to oxidate outside surface of the sleeve 11*a* forms the oxide layer. by relying on the oxide layer, it avoids the sleeve 11*a* to be thermal conducted with the heating element 12*a*.

Figure 4:
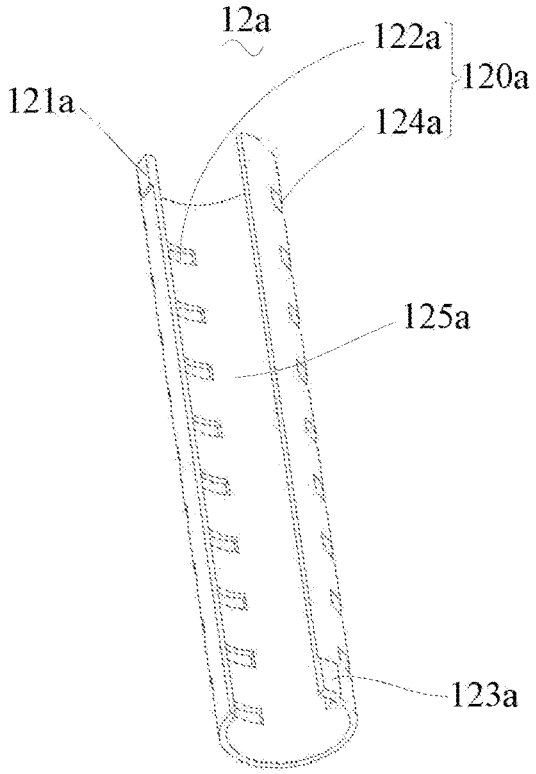
FIG. 4 illustrates the heating element of FIG. 2.

Further referring FIG. 4, the above heating element 12*a* is shaped like a hollow cylinder, made up with metallic materials, such as stainless steel sheets in this embodiment. The stainless steel sheet brings the heating element 12*a* fashionable and beautiful appearance, strong corrosion resistance that prolongs using life of the vaporizer 10*a*. In some embodiments, a thickness of the heating element 12*a* is 0.4 mm that may accelerate the heating speed.

The heating element 12*a* includes a first electrode 121*a* and a second electrode 123*a*; the first electrode 121*a* and the second electrode 123*a* are electronically connected with the power supply module 13*a* to heat the heating element 12*a*. As shown in FIG. 4, the first electrode 121*a* and the second electrode 123*a* are respectively disposed at two longitudinal ends of the heating element 12*a* to make the current through the heating element 12*a* completely.

The heating element 12*a* has numerous sets of through holes 120*a*, divided into first sets of through holes 122*a* and second sets of through holes 124*a*; the first sets of through holes 122*a* and second sets of through holes 124*a* are nearly strip-shaped holes, configured for adjusting resistance of the heating element 12*a*. The first sets of through holes 122*a* and second sets of through holes 124*a* are symmetrically set with each other, to make the current evenly through the heating element 12*a*. Each set of through holes 122*a* and 124*a* includes at least one through holes that is axially dispersed on the heating element 12*a*. The number of sets of first through holes 122*a* and the number of sets second through holes 124*a* may be determined based on different situations. More specifically, the first sets of through holes 122*a* and second sets of through holes 124*a* are symmetrically set with each other, to make the current evenly through the heating element 12*a*, so the heating element 12*a* heats evenly.

In other embodiments, there are no sets of through holes 120*a*, whereas, by diminishing or increasing the length of the heating element 12*a*, it may adjust resistance of the heating element 12*a*.

In other embodiments, the heating element 12*a* has a cut 125*a*, configured for the heating element 12*a* to be easily sleeved on the sleeve 11*a*; the cut 125*a* is axially bored on the heating element 12*a*, through a side wall of the heating element 12*a*. The first electrode 121*a* and the second electrode 123*a* may be disposed at two sides of the cut 125*a*, so the heating element 12*a* heats completely.

Figure 5:
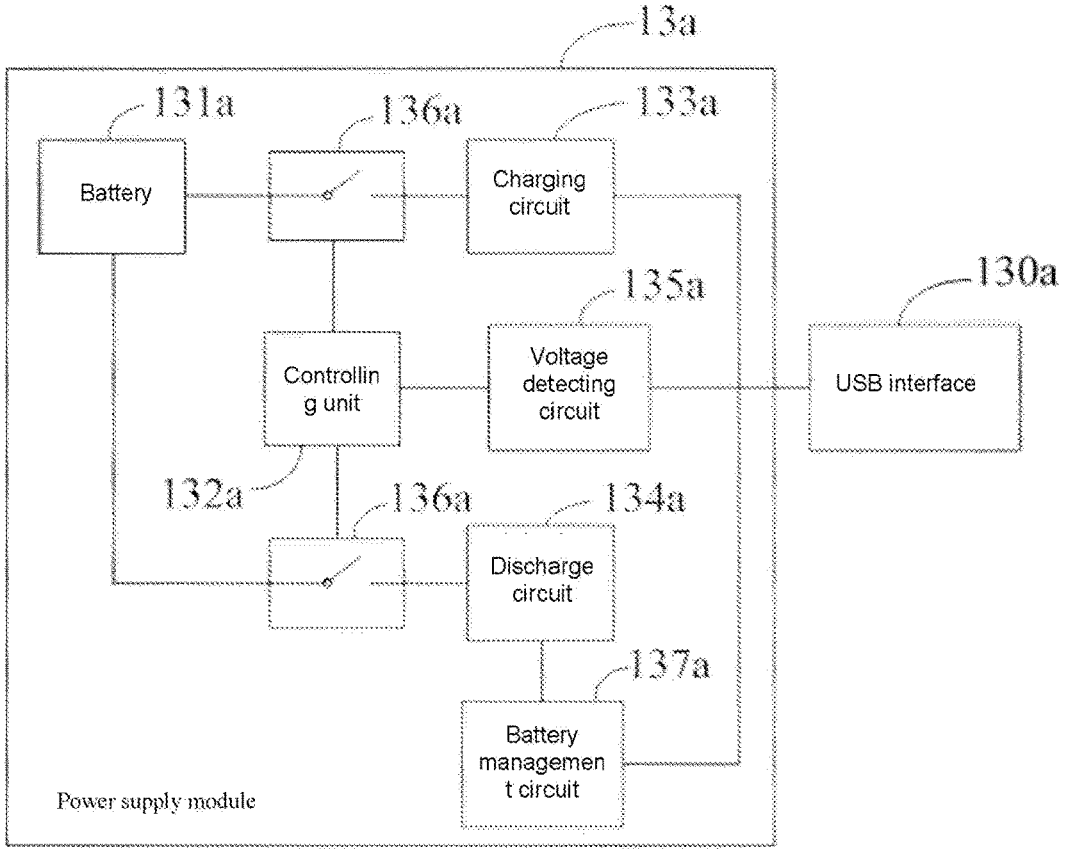
FIG. 5 illustrates the power supply module of FIG. 2.

Referring to FIG. 5, the above power supply module 13*a* may be respectively connected with the first electrode 121*a* and the second electrode 123*a* via threads, to be electrically connected with the heating element 12*a*. The power supply module 13*a* includes an USB interface 130*a*, a battery 131*a*, a control unit 132*a*, a charge circuit 133*a*, a discharge circuit 134*a*, a voltage detecting circuit 135*a*, two switches 136*a* and a battery management circuit 137*a*. The battery 131*a* is respectively connected with the charge circuit 133*a* and the discharge circuit 134*a*. Two switches 136*a* are respectively disposed between the battery 131*a* and the charge circuit 133*a*, and between the battery 131*a* and discharge circuit 134*a*. The charge circuit 133*a* and the discharge circuit 134*a* are both electrically connected with the USB interface 130*a*, the discharge circuit 134*a* is electrically connected with the battery management circuit 137*a*; the battery management circuit 137*a* is electrically connected with the heating element 12*a*; the voltage detecting circuit 135*a* is electrically connected with the USB interface 130*a*; the control unit 132*a* is connected with the two switches 136*a* and the voltage detecting circuit 135*a* respectively. The discharge circuit 134*a* is electrically connected with the battery management module 137*a*. The battery management module 137*a* is configured for supplying power to the heating element 12*a*. If the voltage detecting circuit 135*a* receives the voltage, that means, the power supply module 13*a* is connected with the external power supply, the voltage detecting circuit 135 sends an electricity signal to the control unit 132*a*; after the control unit 132*a* receives the electrical signal, the control unit 132*a* controls the switch 136*a* between the battery 131*a* and charging circuit 133*a* to make "off" state alternative to "on" state, so the current from the external power supply supplies power to the battery 131*a* through the charging circuit 133*a*. If the voltage detecting circuit 135*a* fails to detect the voltage, that means the power supply module 13*a* fails to be electrically conducted with the external power supply, the control unit 132*a* generates another electrical signal, the control unit 132*a* receives the electrical signal and controls the other switch 136*a* between the battery 131*a* and the discharge circuit 134*a*, making "off"' state alternative to "on" state, the current passes towards the heating element 12*a* through the discharge circuit 134*a* and the battery management module 137*a*.

In this embodiment, the vaporizer 10*a* includes the sleeve 11*a*, the heating element 12*a* and power supply module 13*a*. By relying on electrical connection between the power supply module 13*a* and the heating element 12*a*, the heating element 12*a* is sleeved outside the sleeve 11*a*. The heating element 12*a* has a plurality sets of through holes 120*a*, for adjusting the resistance of the heating element 12*a* that can evenly heat the whole sleeve 11*a*. The sleeve 11*a* and the heating element 12*a* made by metallic materials, which can improve the heating temperature, make the heating element 12*a* produce smoking smog faster and eventually improve the user experience.

In these embodiments, the solid vaporizable materials 20*a* may be at least one or more selected from a group of tobacco slices and tobacco sauces, or a group of tobacco rods, tobacco paste or herbs etc.

In these embodiments, the housing 30*a* is nearly a hollow cylinder, configured for receiving the vaporizer 10*a*. The housing 30*a* may be a plastic shell such as polycarbonate, polyurethane, polyimide and some plastic materials with good heat preservation effect. In some embodiments, the housing 30*a* is made from a metallic housing with coating a plastic membrane to itself, which comes to effect of heat preservation.

In these embodiments, the low-temperature baked smoking set 100*a* includes a vaporizer 10*a* for improving the heating temperature, making the low-temperature baked smoking set 100*a* available for producing smoking smog faster, therefore the user experience is effectively improved.

Figure 6:
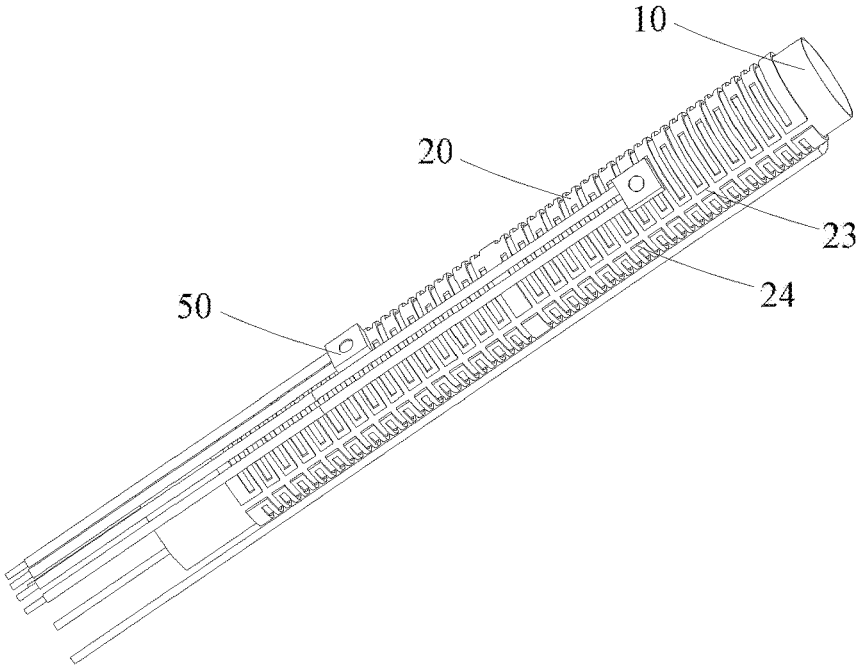
FIG. 6 illustrates the assembled vaporizer in the low-temperature baked smoking set.
Figure 7:
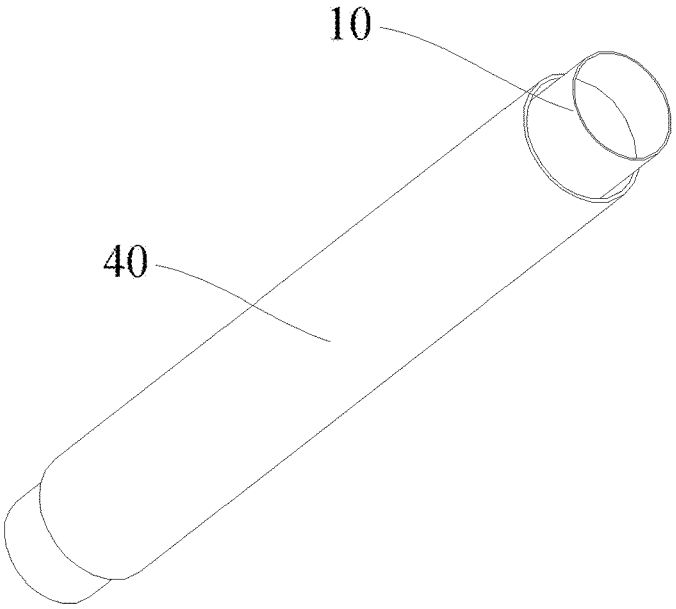
FIG. 7 illustrates the sleeve of FIG. 6.
Figure 8:
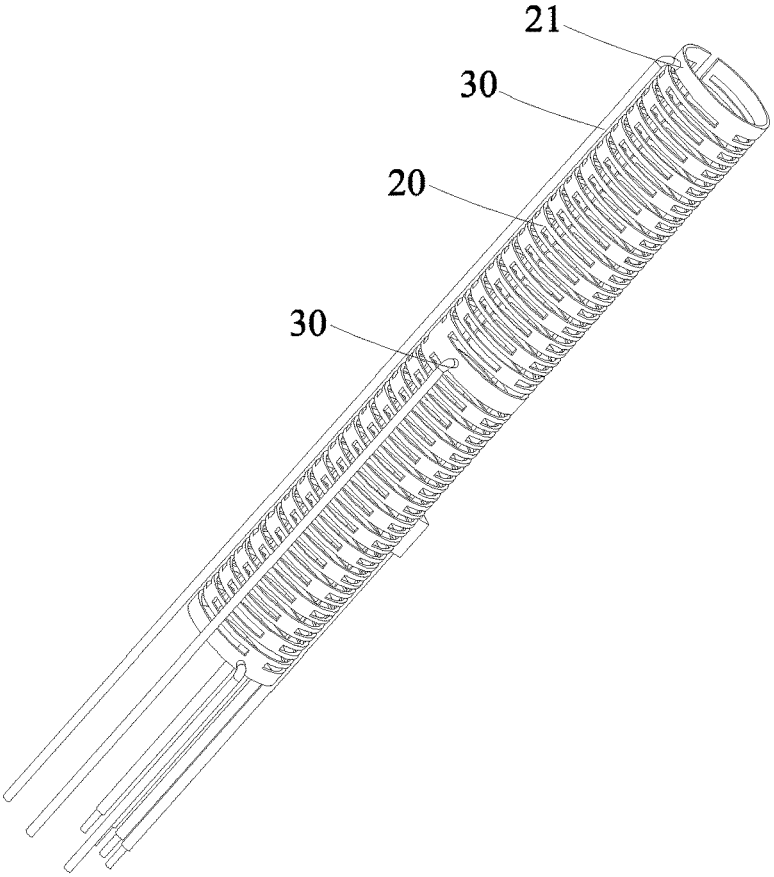
FIG. 8 illustrates the heating element of FIG. 6.

Beyond the above embodiments, the present disclosure relates to another vaporizer in accordance with another embodiment, as shown from FIG. 6 to FIG. 8. FIG. 6 illustrates the assembled vaporizer in the low-temperature baked smoking set. FIG. 7 illustrates the sleeve of FIG. 6. FIG. 8 illustrates the heating element of FIG. 6. The vaporizer include a hollow sleeve 10, a heating element 20 surrounded around the hollow sleeve 10 and an electrode connector 30 carried on the heating element 20.

The sleeve 10 is made from thermal conductive materials, configured for receiving the solid vaporizable materials inside;

The shape of the heating element 20 is matched with the cylindrical-shaped of the sleeve 10, since the heating element 20 is sleeved outside the sleeve 10, configured for heating the vaporizable materials.

The electrode connector 30 is defined as an electrode pin as shown in FIG. 6 to FIG. 8, and configured for connecting with an output electrode of the power supply module, supplying power to the heating element 20 for generating heat. It makes sense that the electrode pins are the most common electrode connecting components in the prior arts; except for the electrode pins in the present disclosure, the electrode connectors 30 further may be electrode poles or terminals etc.

Furthermore, in accordance with the above embodiments, the heating element 20 is made from electric materials in favor of heating the vaporizable materials, such as pure nickel alloys, nickel-chrome alloys, nickel-iron alloys, iron-chromium alloys, iron-chromium-aluminum alloys, titanium alloys and stainless steels etc. But the sleeve 10 is made from better thermal-conductive materials, like metallic materials, such as pure metals, alloys, metallic compounds or specialty materials etc., of which the alloys are composed of at least one of irons, coppers, aluminums, tins, gold, silver etc. Since the sleeve 10 adopts the metallic materials, electrical-conduction between the heating element 20 and the sleeve 10 is avoided, by an insulating layer 40 disposed between the sleeve 10 and outside surface of the heating element 20. The insulating layer 40 is made by methods of sputtering, deposition, coating, or attaching films to the surface of the sleeve 10. For a purpose of insulation, the insulating layer 40 itself is made from at least one selected from a group of synthetic resins, polyimide resins, polyurethane resins and metallic oxides etc. The sleeve 10 is configured for receiving the vaporizable materials, inner diameter of the sleeve 10 has to be matched up with the diameter of the vaporizable materials, 5~8 mm are chosen in the present invention, which ensures smooth insertion of the vaporizable materials and ensures the vaporizable materials to tightly abuts against the sleeve 10, eventually improving the heating efficiency.

Figure 14:
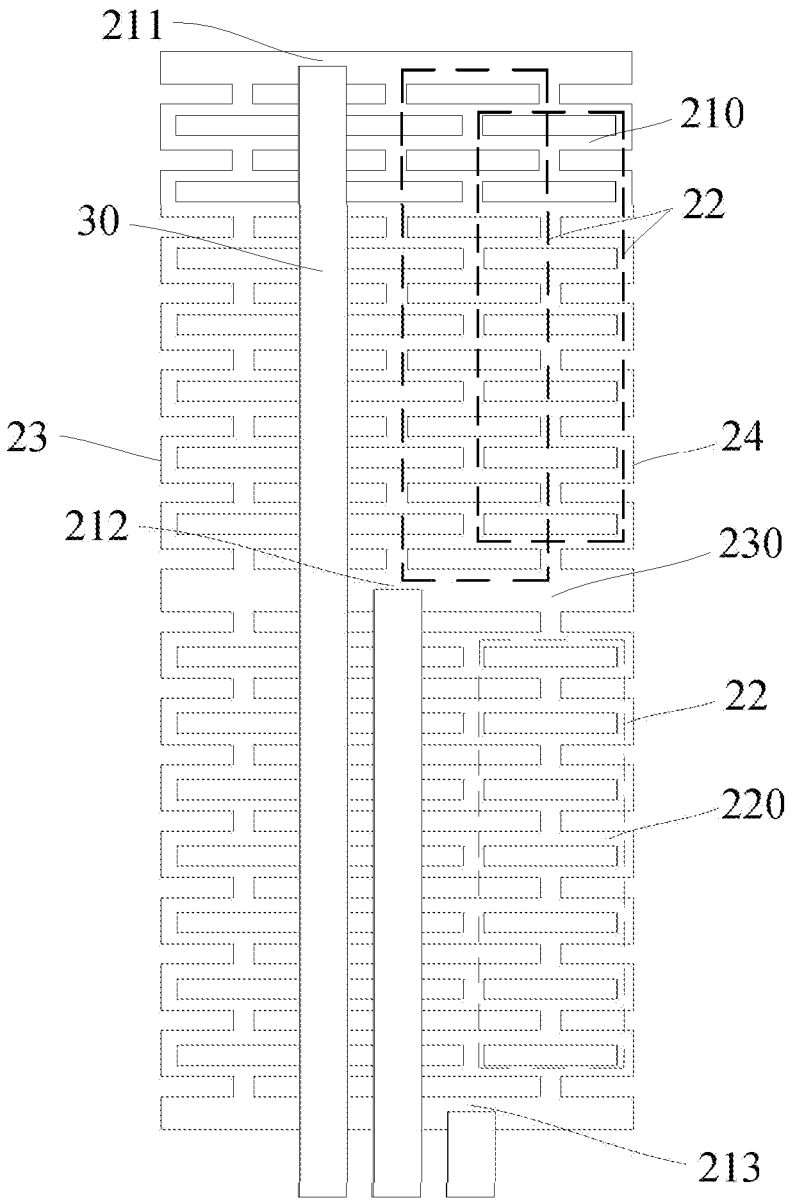
FIG. 14 illustrates the heating element unfolded along a circumferential direction thereof of FIG. 8.

Furthermore, the cylindrical-shaped heating element 20 is formed by wrapping a layer-shaped object around the sleeve 10 along its width direction. To more clearly see the shape of the heating element 20 itself and structure, FIG. 8 illustrates a heating element 20 in use according to embodiments of the present disclosure. FIG. 14 also illustrates the heating element unfolded circumferentially of FIG. 8. The heating element 20 itself as a layer-shaped structure is wrapped around the outside surface of the sleeve 10 which forms a cylinder to match up with the sleeve 10. The layer-shaped heating element 20 has an even thickness from a range of 0.03~0.1 mm.

Further referring to FIG. 8 to FIG. 14, two longitudinal ends of the heating element 20 include the electrode connecting parts 21, the above electrode connectors 30 are electrically connected with the electrode connecting parts 21. Of course, the number of the electrode connecting parts 21 is at least two. For example, the first electrode connecting part 211 and the second electrode connecting part 212 are respectively connected with a positive electrode and a negative electrode of the power supply to from current loops. The material of the electrode connecting parts 21 is the same as the electrode connector 30. In embodiments of the present disclosure, the electrode connectors 30 are electrode pins, then the corresponding electrode connecting parts 21 are pin welding points. In some embodiments, the electrode connectors 30 are plug terminals, the electrode connecting parts 21 are plug points available for the plug terminals. Under the circumstance, based on the shape of the heating element 20, it is best to adopt the way of pin welding. Of course, in other feasible situations, multiple other welding methods may be adopted.

Furthermore, as shown in FIG. 6, and from FIG. 9 to FIG. 13, the above heating element 20 has a first side edge 23 and a second side edge 24 along a breadth direction thereof. The above first electrode connecting part 211 and second electrode connecting part 212 both are disposed at a certain position, like, a central position between the first side edge 23 and the second side edge 24. As shown in FIG. 6, when the heating element 20 is wrapped around the sleeve 10, the first side edge 23 and the second side edge 24 are closing but contactless with each other, remaining about 1~5 mm distance therebetween, which may basically cover the circumferential surface of the sleeve 10, but also avoid overheating due to the contact of the first side edge 23 and the second side edge 24.

Furthermore, to make the current evenly passing through the heating element 20, and ensure every area of the heating element 20 with a suitable resistance, the heating element 20 is bored with some through holes. For example, according to the power for heating in normal use, the whole resistance of the heating element 20 maintains at 04~1.0 ohms. As shown from FIG. 9 to FIG. 13, the heating element 20 is opened with a plurality sets of through holes 22 along a breadth direction or a circumferential direction of the heating element 20. The plurality sets of through holes 22 are provided to increase resistance of an area of the heating element 20 near to the electrode connecting part 21 and also increase resistance of an area of the heating element 20 far away from the electrode connecting part 21, as an aid to equal the resistances of the area near to the electrode connecting part 21 and the area far away from the electrode connecting part 21, so the whole heating element 20 circumferentially generates heat evenly. For achieve an even resistance, the plurality sets of through holes 22 are arrayed unevenly, the array of sets of through holes is shown from FIG. 9 to FIG. 13.

Figure 9:
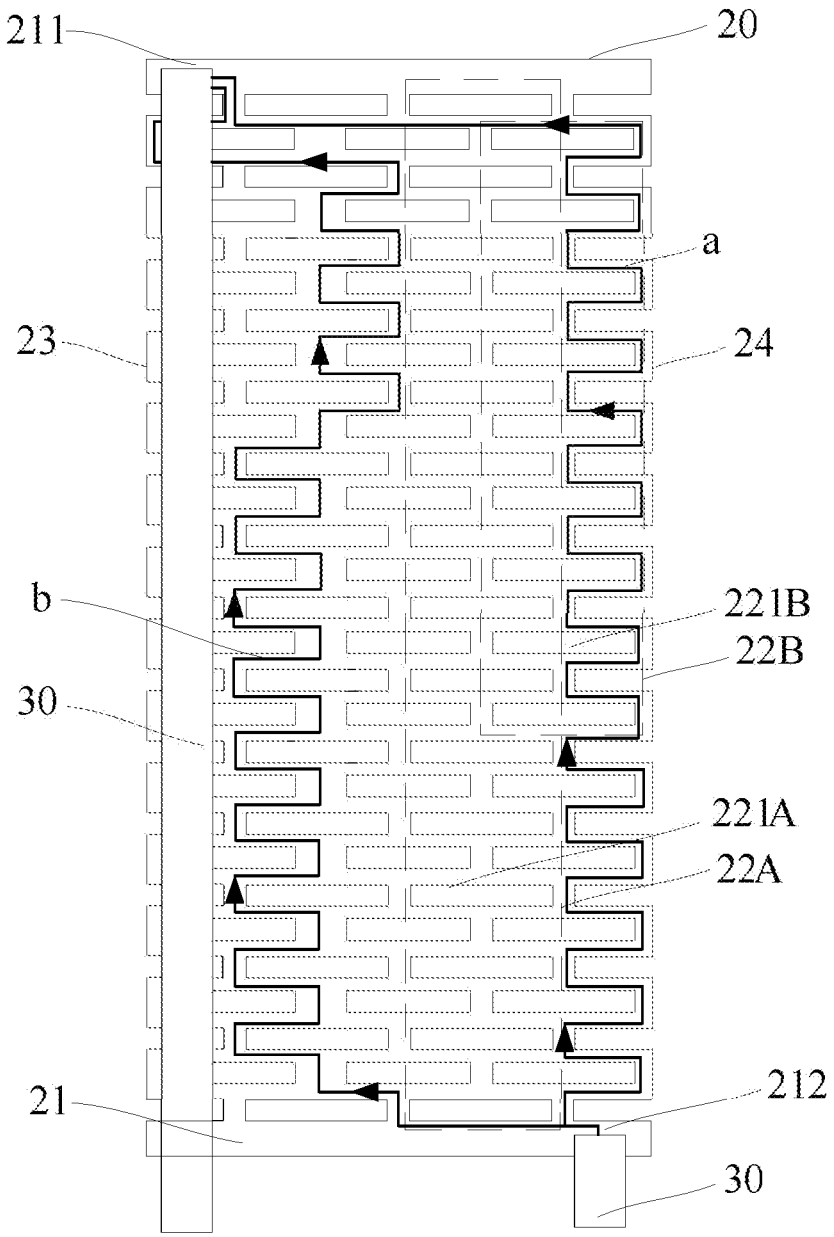
FIG. 9 illustrates the heating element unfolded along a circumferential direction thereof in accordance with another embodiment of the present disclosure.

In terms of the heating element 20 in FIG. 9, two longitudinal ends of the heating element 20 are the electrode connecting parts 21, i.e. the first electrode connecting part 211 and the second electrode connecting part 212, which are respectively connected with the positive and negative terminals of the power supply via the electrode connectors 30. Each set of through holes 22 arrayed on the heating element 20 has at least one through hole 221 along a length direction, that is, an axial direction after the heating element 20 is wrapped. Along a breadth direction, adjacent sets of through holes 22 are staggered with each other, for example, the adjacent set of through holes 22A and the adjacent set of through holes 22B are arrayed in the staggered manner, not in the aligned manner, therefore, the current path and resistance would be more diffusive, to let the heating element 20 generate heat more evenly. For example, in FIG. 9, two currents a and b are dispersed at two different areas, but the current density, current value and resistance of currents a and b come to the same, therefore, the heat generated by the heating element 20 is basically the same in different areas.

According to the embodiment shown in FIG. 9, the through holes 221 belonging to one same set of through holes 22 may be same in the shape, the size and the distance.

Of course, the through holes 221 belonging to the same set of through holes 22 may be different in the shape, the size and the distance.

Figure 10:
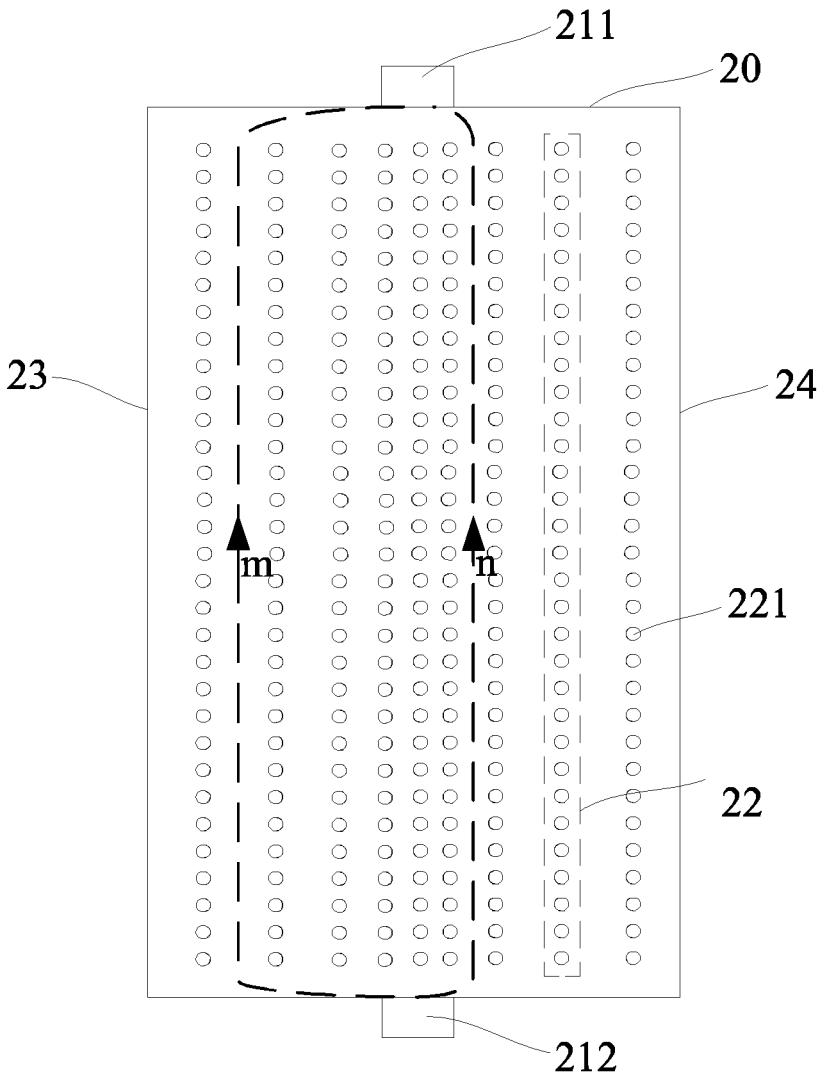
FIG. 10 illustrates the heating element unfolded along a circumferential direction thereof in accordance with another embodiment of the present disclosure.

As shown in FIG. 10, which illustrates the heating element unfolded along a circumferential direction thereof in accordance with another embodiment of the present disclosure. In this embodiment, each set of through holes 22 has at least one through holes 221 along a length direction of the heating element 20. When these sets of through holes 22 are arrayed along a breadth direction of the heating element 20, the distance between adjacent sets of through holes 22 gets larger along a direction deviating from the electrode connecting part 21, basically, to make smaller size of through holes closing to the first side edge 23 or the second side edge 24 compared with through holes closing to the electrode connecting part 211. In this case, the resistances of different areas in the heating element 20 have been changed again, and the distance between adjacent sets of through holes 22 gets larger along a direction deviating from the electrode connecting part 21, so the resistance of an area closing to the electrode connecting part 21 is increasing, and the resistance increase rate of the area near to the electrode connecting part 21 is larger than the resistance increase rate of the area far away from the electrode connecting part 21, as an aid to adjust the resistance of the whole heating element 20 with consequently even current, so the whole heating element 20 circumferentially generates heat evenly. For example, FIG. 10 shows two current paths m and n, even through the current path m has longer itinerary then the current path n from the electrode connecting part 211 to the electrode connecting part 212, since the adjusted resistances of the current path m and the current path n come to be same, finally, the current paths m and n have equal current value, therefore generating even heat.

Figure 11:
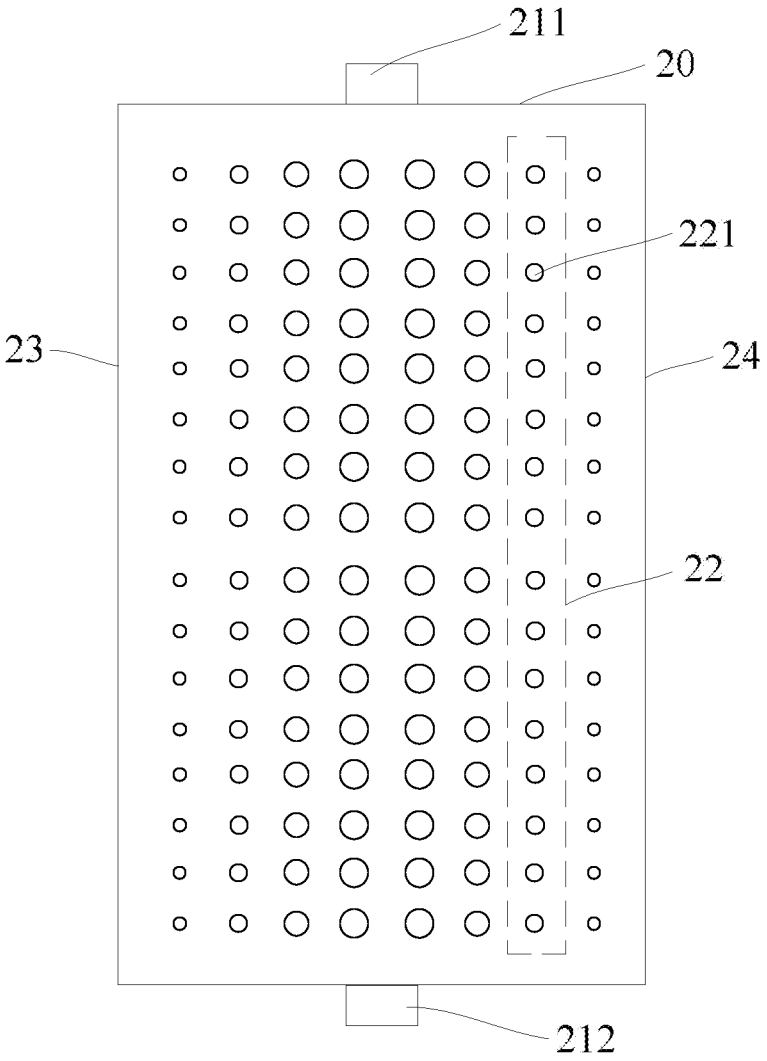
FIG. 11 illustrates the heating element unfolded along a circumferential direction thereof in accordance with another embodiment of the present disclosure.

Meanwhile, other embodiments of the present disclosure relate to another method to achieve even resistance of the whole heating element 20 by designing sets of through holes 22 arrayed along a breadth direction. As shown in FIG. 11, the adjacent sets of through holes 22 have the same distance along a breadth direction, but with deviating from the electrode connecting part 21 the size of each through hole 221 in each set of through holes 22 is decreasing, under the circumstance, the resistance of the area closing to the electrode connecting part 21 is increasing, the resistance increasing rate of the area near to the electrode connecting part 21 is larger than a resistance increasing rate of the area far away from the electrode connecting part 21, as an aid to even the resistance of the whole heating element 20, consequently, the heating element 20 generates even heat. Likewise, the through holes 221 in one set of through holes 22 have same size and are arrayed in same distance between adjacent through holes 221 along the length direction thereof, which contributes to even the resistance of the heating element 20 along the length direction thereof.

Understandable, the above two arraying method in the aforementioned embodiments in FIG. 10 and FIG. 11 may be combined in use, the sets of through holes 22 may be arrayed with that the sizes are gradually decreasing and the distances are gradually increasing simultaneously along a breadth direction of the heating element 20, as another aid to even the resistance of the whole heating element 20.

Understandable, the embodiments as shown in FIG. 10 and FIG. 11, the through holes 221 in the sets of through holes 22 have variable sizes and distances along a direction deviating from the electrode connecting part 21. Since the electrode connecting parts 21 are respectively disposed at middle of two longitudinal ends of the heating element 20, to make the main current paths as shown in FIG. 10 and FIG. 11 distributive around the shortest itinerary from the upper and lower electrode connecting parts 21. Therefore, by relying on the electrode connecting parts 21 as a start of the variable through holes 221 to change the sizes and distances of the through holes 221, these variable through holes 221 may make the resistances of different areas of the heating element 20 even. When the electrode connecting parts 21 are not at middle as shown in FIG. 10 and FIG. 11, the through holes 221 in the sets of through holes 22 with variable sizes, distances and the start of the variable through holes 221 have to be in accordance with the position of the electrode connecting parts 21.

Figure 12:
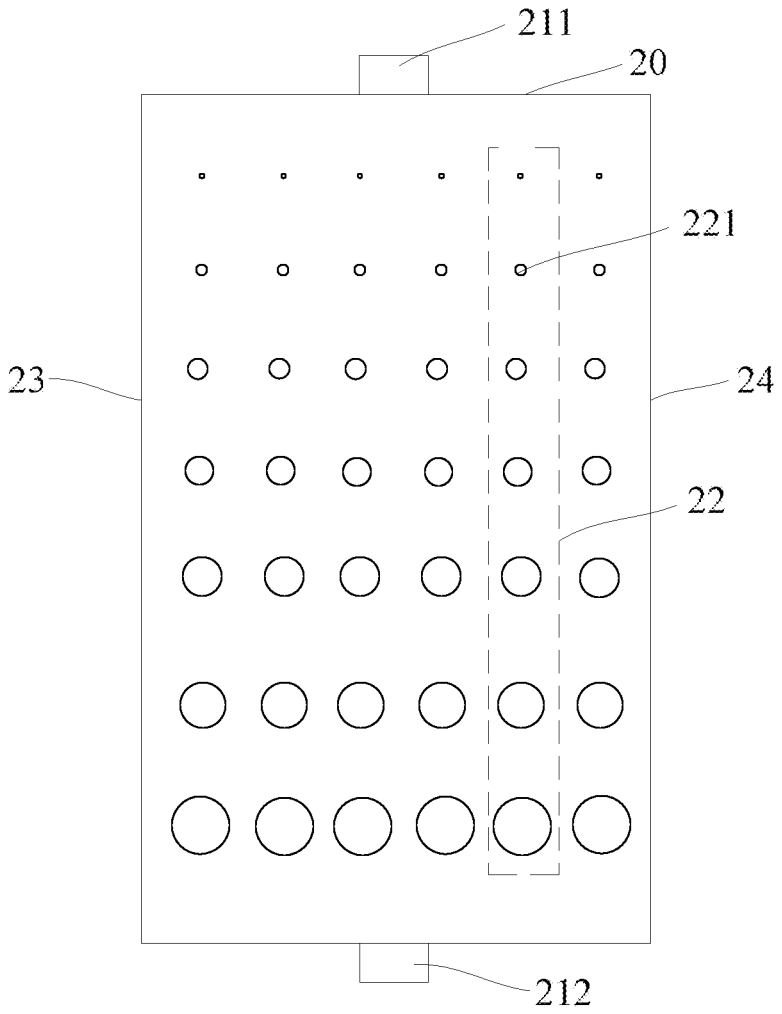
FIG. 12 illustrates the heating element unfolded along a circumferential direction thereof in accordance with another embodiment of the present disclosure.
Figure 13:
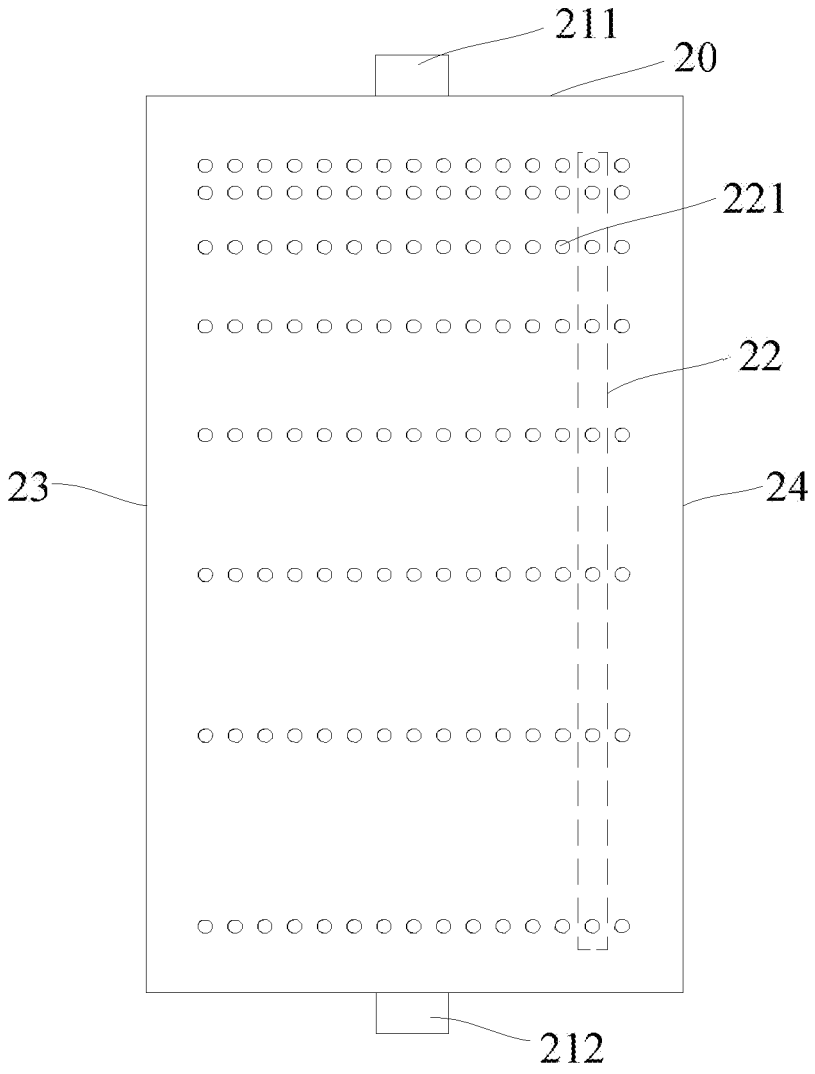
FIG. 13 illustrates the heating element unfolded along a circumferential direction thereof in accordance with another embodiment of the present disclosure.

Further, referring to FIG. 12 and FIG. 13, FIG. 12 illustrates the heating element unfolded along a circumferential direction thereof in accordance with another embodiment of the present disclosure. Under the circumstance, through holes 221 in each set of through holes 22 are arrayed with decreasing sizes along the length direction. However, in FIG. 13, which illustrates the heating element unfolded along a circumferential direction thereof in accordance with another embodiment of the present disclosure. All through holes 221 in each set of through holes 22 are arrayed with increasing distances along the length direction.

With the aforementioned two kinds of arrays of through holes 221 in sets of through holes 22 in changing sizes and distances, because of the current paths dividing and combining manifolds along the length direction, the resistance of the whole heating element 20 has changed, that means the heating area on the original heating element 20 has been decentralized and restrained, so as to even the resistance of the heating areas on the heating element 20.

In some embodiments, the through holes 221 in sets of through holes 22 may have variety of shapes, such as round, rectangular or hexagon and so on.

During the low-temperature smoking set is inhaled, since at beginning the vaporizable materials, like a brand new tobacco cigarette has a plenty of tobacco, a big amount of smoking smog may be generated, but with the increasing time for baking the tobacco cigarette, the amount of smoking smog will be decreased. So after the tobacco cigarette is baked for a while, to improve the amount of smoking smog and even the amount of smoking smog in a whole process of inhaling, a heating element 20 as shown in FIG. 14 is adapted. In the embodiment, the heating element 20 has two heating area in serial connection along a length direction thereof, that is, a first heating area 210 and a second heating area 220, which are both disposed between the first side edge 23 and the second side edge 24. The first and second heating areas 210, 220 are in serial connection via a connector 230. The first and second heating areas 210, 220 are both opened with sets of through holes 22, nonetheless, the connector 230 is a region with no through holes. By relying on the first heating area 210 and a second heating area 220 in serial connection, they may adjust the length of the tobacco cigarette to improve the amount of smoking smog. More specifically, the longitudinal end of the first heating area 210 has a first connecting part 211, an opposite end of the second heating area 220 has a second connecting part 213. And the connector 230 in serial connection with the first heating area 210 and the second heating area 220 has a connecting part 212 shared by the first heating area 210 and the second heating area 220. The first heating area 210 and the second heating area 220 are respectively electrically connected with the power supply via the first connecting part 211, the second connecting part 213 and the shared connecting part 212. During an initial heating process, the amount of the smoking smog when baking the tobacco cigarette is quite large, it is available to let the first electrode connecting part 212 and the shared connecting part 212 be electrically connected with the positive and negative ends of the power supply via the electrode connectors 30, that are the electrode pins, so that the first heating area 210 works to heat the tobacco cigarette. As the heating time extends, the amount of the smoking smog is gradually reducing, so it needs to change electrode connecting methods: electrically connecting the first electrode connecting part 212 and the second electrode connecting part 213 respectively with positive and negative terminals of the power supply, therefore, the first heating area 210 and the second heating area 220 are both at the heating status then the heating zone and the amount of the smoking smog will be improved. Under the circumstances, the above segmented heating method is used to heat multiple heating areas of the heating element 20, and the control method for controlling the heating process in different statuses, the smoking smog come to be even during different statuses of heating the tobacco cigarette.

Of course, in the above embodiments of segmented heating, the first heating area 210 works first, then the first heating area 210 and the second heating area 220 work simultaneously. In another embodiment, the second electrode connecting part 213 and the shared electrode connecting part 212 are firstly connected with positive and negative terminals of the power supply to let the second heating area 220 work firstly, until the smoking smog reduces then replaced by that the first electrode connecting part 211 and the second electrode connecting part 213 are respectively connected with positive and negative terminals of the power supply, in this case, the first heating area 210 and the second heating area 220 both works to improve the smoking smog.

In the above embodiment as shown in FIG. 14, the number of the heating areas are two, however, in some embodiments, the number is there, four or more, with correspondingly more electrode connecting parts needed. The segmented heating method may let partial heating area of the heating element work firstly, after a while, much more heating areas thereof work. The specific number of heating areas may be determined by the length of the tobacco cigarette and each heating area. When being controlled, the electrode connecting parts corresponding to the heating areas may be electrically connected.

Figure 15:
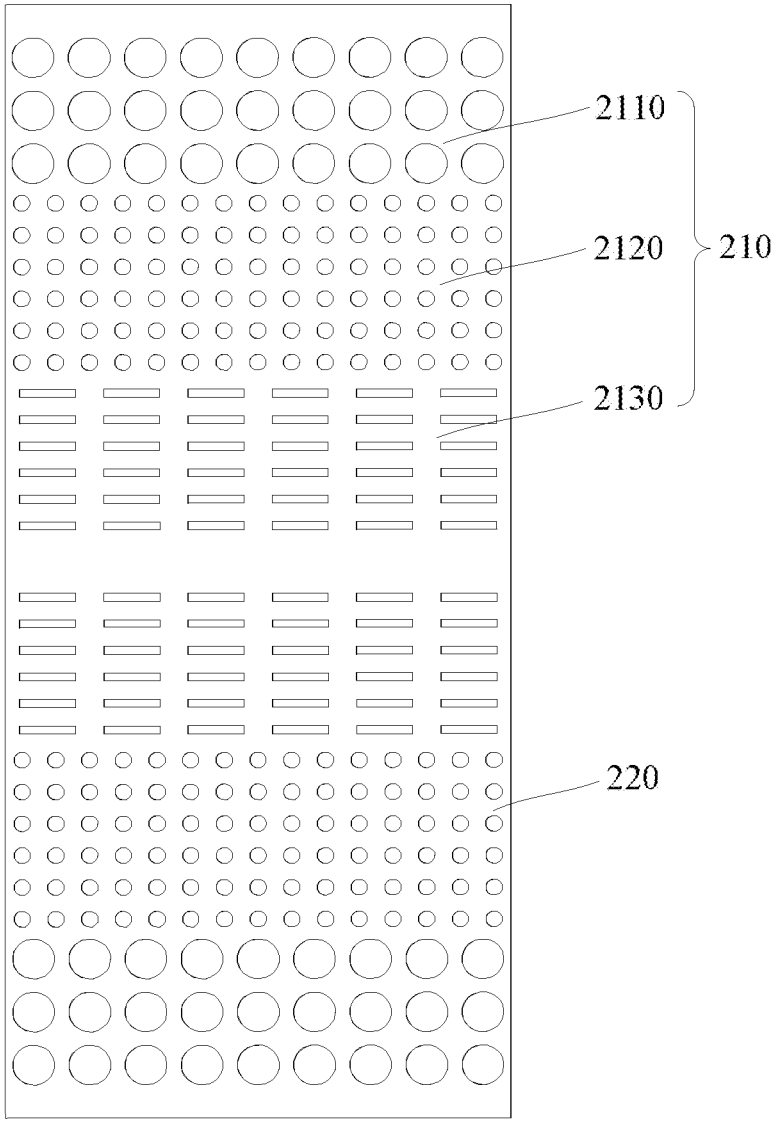
FIG. 15 illustrates the heating element unfolded along a circumferential direction thereof in accordance with another embodiment of the present disclosure.

Based on the above embodiment in FIG. 14, the heating element 20 includes multiple heating areas, such as the first heating area 210 and the second heating area 220. Also, another embodiment of the present disclosure relates to another method to design the heating element 20, each heating area has multiple heating zones. The first heating area 210 includes three heating zones, that is a first heating zone 2110, a second heating zone 2120 and a third heating zone 2130. Each heating zone has several through holes in array-arrangement. The through holes in different heating zones have different shapes and/or sizes, compared with other through holes in other heating zones, like the three heating zones in FIG. 15, through holes with different sizes and shapes are arranged along the length direction, such as comparatively large holes, small holes and square-shaped holes, to further make the resistance of each heating zone come to be the same, so as to improve evenness of heating. Likewise, the second heating area 220 is similar with the first heating area 210, which includes three different through holes with different sizes and shapes. In some embodiments, the number of the heating zones is four or more except from three heating zones in the embodiment, each heating zone has different dimensioned and/or shaped through holes, such as hexagonal or diamond-shaped through holes.

From the aforementioned embodiments, the first heating area 210 includes three heating zones along the length or longitudinal direction of the heating element 20. In some embodiments, the heating zones are arranged along the breadth direction or horizontal direction of the heating element 20.

Based on the sectional heating method, similar to FIG. 14, it makes sense that the longitudinal end of the first heating area 210, the opposite end of the first heating area 210 and the second heating area 220, the serial connected area between the first heating area 210 and the second heating area 220 of the heating element 20 have the electrode connecting parts respectively, for connecting with the positive and negative terminals of the power supply, therefore sectional heating of the tobacco cigarette is realized to make the smoking smog even.

Figure 16:
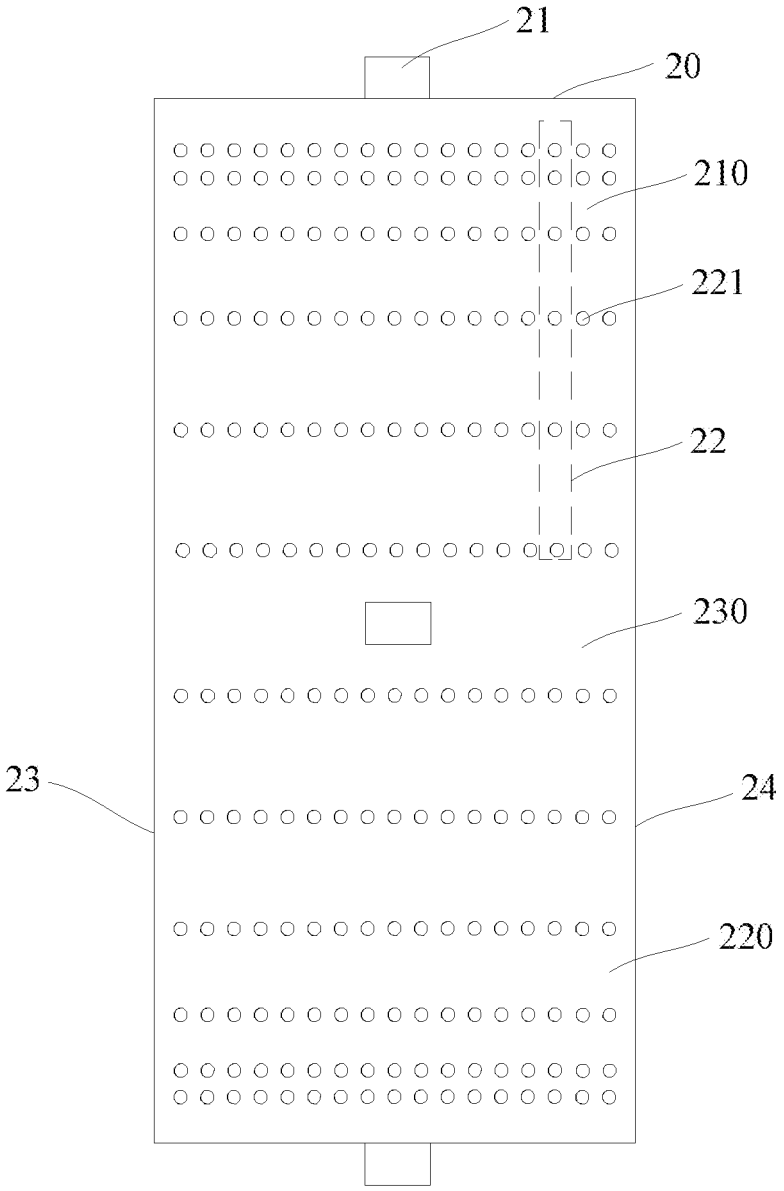
FIG. 16 illustrates the heating element unfolded along a circumferential direction thereof in accordance with another embodiment of the present disclosure.
Figure 17:
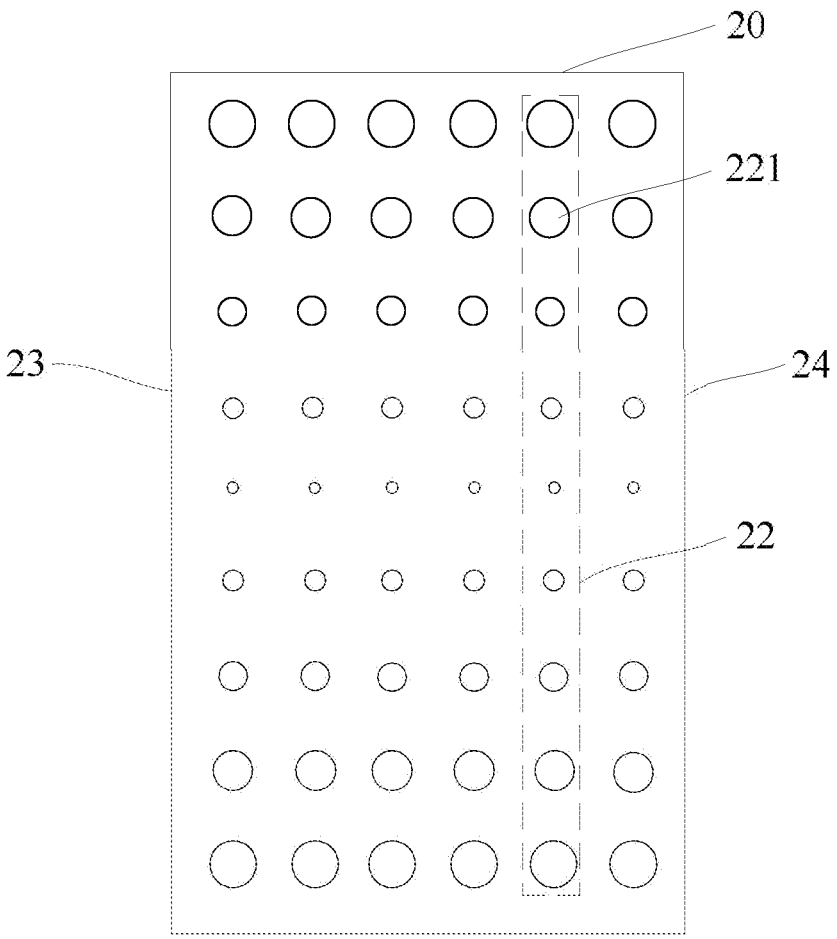
FIG. 17 illustrates the heating element unfolded along a circumferential direction thereof in accordance with another embodiment of the present disclosure.

Likewise, based on the above sectional heating method on the heating element 20, another design of the heating element 20 is shown in FIG. 16 and FIG. 17, and referring to FIG. 16, the heating element 20 also includes two heating areas 210 along a length direction. Each heating area 210 has sets of through holes 22 along a breadth direction of the heating element 20, each set of through holes 22 includes several through holes 221 along the length direction. Meanwhile, through holes 22 in each set of through holes are dimensioned with gradually increasing sizes. The longitudinal end, the opposite end, and between two heating areas 210 respectively have the electrode connecting parts 21 for electrically connecting the power supply. The sectional heating method may be the same as the above embodiment, firstly one heating area 210 works to generate heat by electrically connecting corresponding electrode connecting parts 21, after a while, the whole heating element 20 works to generate heat by electrically connecting the longitudinal end and opposite end of the whole heating element 20, the controlling method realizes the sectional heating.

According to the embodiment in FIG. 17, the controlling method for controlling the heating element 20 to work is similar to FIG. 16, two heating areas are configured for sectional heating, that is the first heating area 210 and the second heating area 220; the differential is that the through holes 221 in each set of through holes 22 are dimensioned with gradually decreasing sizes. In terms of segmental heating, the first heating area 210 has same sets of through holes 22 with the second heating area 220 in same size and same array, such that the first heating area 210 has a same resistance with the second heating area 220. Or the first heating area 210 has different sets of through holes 22 with the second heating area 220 in different size and different array, just to guarantee that the first heating area 210 has a same resistance with the second heating area 220.

In view of the above, the heating element 20 may work as a whole to heat simultaneously, or as the sectional heating in accordance with the aforementioned embodiments. At least two heating areas are arrayed along the axial direction. And each heating area owes corresponding electrode connecting parts for electrically connecting with the power supply, controlled independently. Part of the heating areas is chosen to work when demanded, to realize the effect of sectional heating the tobacco cigarette.

With the above arrays of sets of through holes in changing sizes, changing distances or staggered with each other, the resistance of whole heating element has changed, and comes to even. Meanwhile, referring to the three heating zones in the embodiment of FIG. 15, one heating area is divided into at least two heating zones, different heating zone has different sets of through holes in different shapes and sizes, the resistance of whole heating element has changed too, therefore realizing even heating of the heating element 20.

Figure 18:
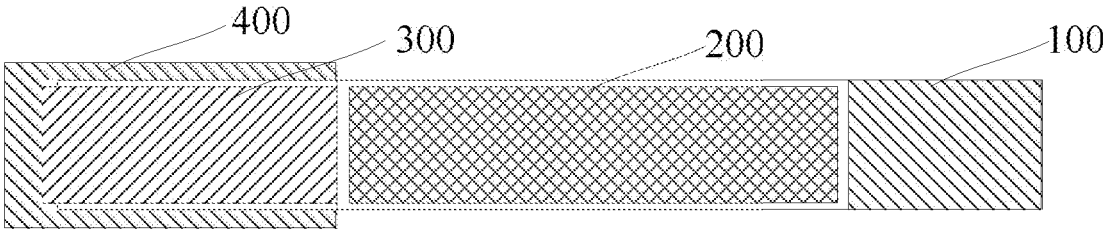
FIG. 18 illustrates the low-temperature baked smoking set assembled with the solid vaporizable materials in accordance with an embodiment of the present disclosure.

In the above embodiments, by changing the sets of through holes in the heating element 20, the resistance of the heating element has reduced longitudinally, to assemble and contact with the tobacco cigarette. More specifically, for low-temperature baked smoking set, the tobacco cigarette has to be inserted into the sleeve of the vaporizer, then inhaled. FIG. 18 illustrates the low-temperature baked smoking set assembled with the tobacco cigarette. The tobacco cigarette includes a mouthpiece 100, a cooling filler 200 and tobacco segments 300 disposed along the axial direction. In use, the tobacco segments 300 are inserted into the vaporizer 400 for being baked, which generates around 260 degree smoking smog, then smoking smog will be cooled by the cooling filler 200, eventually inhaled via the mouthpiece 100. The cooling filler 200 usually has polymer materials for cooling the smoking smog, avoiding overheated smoking smog to be inhaled to scald users. Therefore, when inserting the tobacco cigarette into the vaporizer 400, a certain distance between the vaporizer 400 and the cooling filler 200 is remained, instead of the vaporizer 400 contacting the polymer materials in the cooling filler 200 to burn the polymer materials or produce noxious substances. If the low-temperature baked smoking set adopts the aforementioned vaporizer 400 as shown from FIG. 9 to FIG. 18, the through holes 221 are arranged on the heating element 20 to change the heating areas, the heating areas will be centralized in those areas bored with the through holes 221 while less heat will be generated at the two longitudinal opposite ends of the heating element 20, even through the longitudinal ends of the heating element 20 contacts the cooling filler 200, the temperature is not high enough to burn the polymer materials or let the polymer materials produce noxious substances. So in the process of inserting the tobacco cigarette into the vaporizer 400, the tobacco cigarette may be deeply inserted to abut against the bottom of sleeve of the vaporizer 400, no need for a distance therebetween, which is more convenient.

To monitor the heating process of the heating element itself, based on the above embodiments, a temperature sensor 50 is mounted on the heating element 20, as shown in FIG. 6, according to structure characters of the heating element 20 itself, the temperature sensor 50 may be inserted into the through holes to keep the surface of the heating element 20 flat, which is in favor of sleeve the heating element 20 on the sleeve 10. Of course, the temperature sensor 50 further needs to connect the power supply and the main board in the controlling circuit, configured for receiving and processing the temperature signals, so as to real-time monitor the heating element 20. The number of the temperature sensors 50 is equal to the number of the heating areas in the heating element 20, which may monitor each heating area in the heating element 20.

The present disclosure further relates to a low-temperature baked smoking set including the aforementioned vaporizer 400. The smoking set includes a power supply module configured for supplying power to the vaporizer 400. So the power supply module is electrically connected with the vaporizer 400 via a threaded connection.

By relying on the low-temperature baked smoking set including the aforementioned heating element according to embodiments of the present disclosure, with all kinds of arrays of through holes, they make the whole resistance of the heating element even, with consequently making the current to be even during the vaporizer is working, therefore, the vaporizer generates heat evenly, ensures the solid vaporizable materials, that is the tobacco cigarette to be heated evenly, to improve efficiency and stability of vaporizing smoking smog.

Terminology used herein is for the purpose of describing particular embodiments only and is not intended to be limiting of the invention. Variations may be made to the embodiments and methods without departing from the spirit of the disclosure. Accordingly, it is appropriate that the appended claims be construed broadly and in a manner consistent with the scope of the disclosure.

What is claimed is:

1. A low-temperature baked vaporizer, comprising:

a sleeve, for receiving vaporizable materials; and a heating element, manufactured by metal materials and sleeved outside the sleeve, configured for heating the sleeve;

wherein, the heating element comprises a plurality of through holes, configured for adjusting resistance of the heating element such that the heating element generates heat evenly;

wherein the vaporizer further comprises a power supply module electrically connected with the heating element and configured for supplying power to the heating element;

wherein the power supply module comprises an USB interface, a battery, a control unit, a charge circuit, a discharge circuit, a voltage detecting circuit, two switches and a battery management circuit; the battery is respectively connected with the charge circuit and the discharge circuit; two switches are respectively disposed between the battery and the charge circuit, and between the battery and discharge circuit; the charge circuit and the discharge circuit are both electrically connected with the USB interface, the discharge circuit is electrically connected with the battery management circuit; the battery management circuit is electrically connected with the heating element; the voltage detecting circuit is electrically connected with the USB interface; the control unit is connected with the two switches and the voltage detecting circuit respectively.

2. The vaporizer according to claim 1, wherein, the plurality of through holes are divided to first through holes and second through holes; the first through holes and second through holes are configured to let the heating element heat evenly.

3. The vaporizer according to claim 2, wherein the first through holes and second through holes are axially dispersed on the heating element; at least one first through hole is symmetrical with at least one second through hole.

4. The vaporizer according to claim 1, wherein an insulating layer is disposed around the sleeve and configured for avoiding the sleeve to be thermal conducted with the heating element.

5. The vaporizer according to claim 1, wherein the heating element comprises a cut, configured for the heating element to be easily sleeved on the sleeve; the cut is axially bored on the heating element, through a side wall of the heating element.

6. The vaporizer according to claim 1, wherein the heating element comprises at least one heating area extending along an axial direction thereof, and each heating area comprises electrode connecting parts; the heating area comprises at least one set of through holes dispersed along a circumferential direction thereof; each set of through holes has at least one through holes.

7. The vaporizer according to claim 6, wherein along the circumferential direction of the heating area, the through holes near to the first side edge or the second side edge have a smaller size than the through holes near to the electrode connecting parts.

8. The vaporizer according to claim 6, wherein, in the heating area, along the circumferential direction of the heating area, sizes of through holes in each set of through holes get smaller and smaller with deviating from the electrode connecting parts.

9. The vaporizer according to claim 6, wherein, in the heating area, along the circumferential direction of the heating area, distances between adjacent sets of through holes get larger and larger with deviating from the electrode connecting parts.

10. The vaporizer according to claim 6, wherein, in the heating area, along the circumferential direction of the heating area, adjacent sets of through holes are staggered with each other.

11. The vaporizer according to claim 6, wherein, in the heating area, along the axial direction of the heating element, sizes of through holes in each set of through holes get smaller and smaller.

12. The vaporizer according to claim 6, wherein, in the heating area, along the axial direction of the heating element, distances between adjacent sets of through holes get larger and larger.

13. The vaporizer according to claim 6, wherein, the heating element comprises a first heating area and a second heating area to be axially arrayed; the first heating area and the second heating area both comprises several sets of through holes to be circumferentially arrayed; the first heating area and the second heating area are in serial connection via a connector; the connector is a region with no holes.

14. The vaporizer according to claim 13, wherein, the first heating area comprises same sets of through holes with the second heating area in same size and same array, such that the first heating area has a same resistance with the second heating area.

15. The vaporizer according to claim 13, wherein, the first heating area has different sets of through holes with the second heating area in different size and different array, just to guarantee that the first heating area has a same resistance with the second heating area.

16. The vaporizer according to claim 6, wherein, the heating element comprises at least one temperature sensor thermally conducted with the heating areas, a number of the temperature sensors is the same with the number of the heating areas.

17. The vaporizer according to claim 1, wherein the heating area comprises a first side edge and a second side edge that are close to each other but contactless with each other; the electrode connecting parts disposed between the first side edge and the second side edge, and comprises a first electrode connecting part and a second electrode connecting part disposed at two axial ends of the heating area; between the first electrode connecting part and the second electrode connecting part defines multiple different current circuits along an circumferential direction of the heating area; each current circuit has same resistance.

18. A low-temperature baked smoking set, comprising:

the vaporizer according to claim 1; and a power supply configured for supplying power to the vaporizer.

* * * * *